US009222164B2

(12) United States Patent
Helmick et al.

(10) Patent No.: US 9,222,164 B2
(45) **Date of Patent: *Dec. 29, 2015**

(54) PROCESS FOR FORMING A CHROMIUM DIFFUSION PORTION AND ARTICLES MADE THEREFROM

(75) Inventors: David Andrew Helmick, Fountain Inn, SC (US); Dennis William Cavanaugh, Simpsonville, SC (US); Ganjiang Feng, Greenville, SC (US); David Vincent Bucci, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 769 days.

This patent is subject to a terminal disclaimer.

(21) Appl. No.: 13/226,126

(22) Filed: Sep. 6, 2011

(65) Prior Publication Data

US 2011/0318601 A1 Dec. 29, 2011

Related U.S. Application Data

(63) Continuation of application No. 11/696,385, filed on Apr. 4, 2007.

(51) Int. Cl.
*C23C 10/26* (2006.01)

(52) U.S. Cl.
CPC ..... *C23C 10/26* (2013.01); *Y10T 428/12458* (2015.01)

(58) Field of Classification Search
CPC ..... C23C 10/26; Y10T 428/12458
USPC ..... 148/268, 423, 537; 416/241 R; 427/383.1
See application file for complete search history.

(56) References Cited

U.S. PATENT DOCUMENTS

| | | | |
|---|---|---|---|
| 3,041,040 | A | 6/1962 | Levinstein |
| 3,741,791 | A | 6/1973 | Maxwell et al. |
| 3,864,093 | A | 2/1975 | Wolfla |
| 3,904,382 | A | 9/1975 | Beltran et al. |
| 3,941,903 | A | 3/1976 | Tucker, Jr. |
| 4,034,142 | A | 7/1977 | Hecht |
| 4,124,737 | A | 11/1978 | Wolfla et al. |
| 4,163,071 | A | 7/1979 | Weatherly et al. |
| 4,256,779 | A | 3/1981 | Sokol et al. |
| 4,275,090 | A | 6/1981 | McComas et al. |
| 4,275,124 | A | 6/1981 | McComas et al. |
| 4,585,481 | A | 4/1986 | Gupta et al. |
| 5,277,936 | A | 1/1994 | Olson et al. |
| 5,652,028 | A | 7/1997 | Taylor et al. |
| 5,741,556 | A | 4/1998 | Taylor et al. |
| 5,743,013 | A | 4/1998 | Taylor et al. |
| 5,833,829 | A | 11/1998 | Foster |
| 5,863,668 | A | 1/1999 | Brindley et al. |
| 5,912,050 | A | 6/1999 | Zeigler et al. |
| 6,000,627 | A | 12/1999 | Chernyshov |
| 6,071,628 | A | 6/2000 | Seals et al. |
| 6,254,704 | B1 | 7/2001 | Laul et al. |
| 6,283,715 | B1 | 9/2001 | Nagaraj et al. |
| 6,387,194 | B1 | 5/2002 | Zeigler et al. |
| 6,391,479 | B1 | 5/2002 | Wood |
| 6,410,159 | B1 | 6/2002 | Hermanek |
| 6,454,992 | B1 | 9/2002 | Hebsur |
| 6,503,575 | B1 | 1/2003 | Payne et al. |
| 6,503,576 | B1 | 1/2003 | Russo et al. |
| 6,537,021 | B2 | 3/2003 | Howard et al. |
| 6,571,857 | B2 | 6/2003 | Darolia et al. |
| 6,706,319 | B2 | 3/2004 | Seth et al. |
| 6,808,756 | B2 | 10/2004 | Hajmrle et al. |
| 6,811,898 | B2 | 11/2004 | Ohara et al. |
| 6,833,203 | B2 | 12/2004 | Bose et al. |
| 6,884,524 | B2 | 4/2005 | Ackermann et al. |
| 6,921,251 | B2 | 7/2005 | Ackermann et al. |
| 7,128,962 | B2 | 10/2006 | Braillard et al. |
| 7,364,801 | B1 | 4/2008 | Hazel et al. |
| 2002/0187336 | A1 | 12/2002 | Khan et al. |
| 2004/0202885 | A1 | 10/2004 | Seth et al. |

(Continued)

FOREIGN PATENT DOCUMENTS

| | | | |
|---|---|---|---|
| EP | 1052024 | A1 | 11/2000 |
| EP | 1225251 | B1 | 7/2002 |

(Continued)

OTHER PUBLICATIONS

International Search Report; International Application No. 06124418.2; Date of Completion of the International Search Report: Jan. 18, 2007; Date of Mailing: Feb. 13, 2007; 9 pages International Search Report; International Application No. 06124284.8; Date of Completion of the International Search Report: Jan. 9, 2007; Date of Mailing: Feb. 5, 2007; 4 pages.

International Search Report; International Application No. 08153465.3; Date of Completion of the International Search Report: Jul. 24, 2008; Date of Mailing: Aug. 1, 2008, 6 pages.

Luthra K.L. et al., "Proceedings of a Symposium on High Temperature Coatings: Coating/Substrate Interactions at High Temperature"; Oct. 7, 1986; pp. 85-100.

Tampa Electric, online, retrieved on Oct. 31, 2005; retrieved from the Internet http://www.manatee-teco.com/TEEVPowerPlantsIGCC.cfm; "Intergrated Gasification, Combined-Cycle"; 2 pages. .

(Continued)

*Primary Examiner* — Roy King
*Assistant Examiner* — Caitlin Kiechle
(74) *Attorney, Agent, or Firm* — Ernest G. Cusick; Frank A. Landgraff

(57) ABSTRACT

In one embodiment, a method for forming an article with a diffusion portion comprises: forming a slurry comprising chromium and silicon, applying the slurry to the article, and heating the article to a sufficient temperature and for a sufficient period of time to diffuse chromium and silicon into the article and form a diffusion portion comprising silicon and a microstructure comprising α-chromium. In one embodiment, a gas turbine component comprises: a superalloy and a diffusion portion having a depth of less than or equal to 60 μm measured from the superalloy surface into the gas turbine component. The diffusion portion has a diffusion surface having a microstructure comprising greater than or equal to 40% by volume α-chromium.

1 Claim, No Drawings

(56) References Cited

U.S. PATENT DOCUMENTS

| | | | |
|---|---|---|---|
| 2005/0112411 | A1 | 5/2005 | Gray et al. |
| 2005/0265851 | A1 | 12/2005 | Madhava et al. |
| 2005/0287296 | A1 | 12/2005 | Wadley et al. |
| 2007/0116809 | A1 | 5/2007 | Pareek et al. |
| 2008/0245445 | A1 | 10/2008 | Helmick et al. |

FOREIGN PATENT DOCUMENTS

| | | | |
|---|---|---|---|
| EP | 1229146 | A2 | 8/2002 |
| EP | 1634976 | A1 | 3/2006 |
| EP | 1839775 | A1 | 10/2007 |
| GB | 2063305 | A | 6/1981 |
| GB | 2069009 | A | 8/1981 |
| GB | 2378452 | A | 2/2003 |
| WO | 9723303 | | 7/1997 |

PROCESS FOR FORMING A CHROMIUM DIFFUSION PORTION AND ARTICLES MADE THEREFROM

CROSS-REFERENCE TO RELATED APPLICATION

This application is a continuation of U.S. patent Ser. No. 11/696,385, filed Apr. 4, 2007, which is incorporated herein in its entirety.

U.S. GOVERNMENT INTEREST

This invention was made with government support under Contract No. DE-FC26-05NT42643 awarded by the U.S. Department of Energy. The government has certain rights in the invention.

BACKGROUND

When exposed to high temperatures (i.e., greater than or equal to about 1,300° C.) and to oxidative environments, metals can oxidize, corrode, and become brittle. These environments are produced in turbines such as those used for power generation applications. Metallic coatings, when applied to metal turbine components such as via thermal spraying techniques, can reduce the effects that high-temperature, and corrosive and oxidative environments have on the metal components.

The family of thermal spray processes include detonation gun deposition, high velocity oxy-fuel deposition (HVOF) and its variants such as high velocity air-fuel, plasma spray, flame spray, and electric wire arc spray. In most thermal coating processes a material is heated to near or somewhat above its melting point and droplets of the material accelerated in a gas stream. The droplets are directed against the surface of a substrate to be coated where they adhere and flow into thin lamellar particles called splats.

Thermal spray coating processes have been used for many years to deposit layered coatings. These coatings consist of discrete layers of different composition and properties. For example, the coating may be a simple duplex coating consisting of a layer of a metal alloy such as nickel-chromium adjacent to the substrate with a layer of zirconia over it.

A current problem exists when MCrAlY coatings are used in integrated gasification combined cycle (IGCC) systems; that is, systems using an innovative process that uses coal to produce power. The process is cleaner and more economically efficient than other processes that use coal to produce power. The process involves treating coal and reforming coal to a gas mixture that includes hydrogen gas ($H_2$), carbon monoxide (CO), and carbon particulates. This gas mixture is combusted with oxygen in a turbine to produce power. The carbon particulates, however, collide with the coated turbine components and erode the components and/or coatings, and thereby shorten the effective operating life of the components.

Another turbine component problem exists in that they also experience premature failure due to environmental attack, particularly in the hot gas path of the gas turbine engine.

Therefore, there exists a need for articles, such as turbine components, that have enhance resistance to harsh environments such as those in a gas turbine.

SUMMARY OF THE INVENTION

Disclosed herein are methods for forming chromide diffusion portions in articles and articles made therefrom. In one embodiment, a method for forming an article with a diffusion portion comprises: forming a slurry comprising chromium and silicon, applying the slurry to the article, and heating the article to a sufficient temperature and for a sufficient period of time to diffuse chromium and silicon into the article and form a diffusion portion comprising silicon and a microstructure comprising α-chromium.

In one embodiment, a gas turbine component comprises: a superalloy and a diffusion portion having a depth of less than or equal to 60 μm measured from the superalloy surface into the gas turbine component. The diffusion portion has a diffusion surface having a microstructure comprising greater than or equal to 40% by volume α-chromium.

In one embodiment, an article comprises: a superalloy article comprising a diffusion portion. The diffusion portion has a 25% depth of the diffusion portion, as measured from a surface of the depth portion toward a center of the article, comprising less than or equal to 5 wt % silicon, based upon a total weight of that 25% depth, and having a microstructure comprising greater than or equal to 50% by volume α-chromium.

The above described and other features are exemplified by the following detailed description and appended claims.

DETAILED DESCRIPTION

Enhanced high temperature protection of an article (e.g., turbine component, and particularly a component comprising a superalloy, e.g., a nickel (Ni) and/or cobalt (Co) based alloy (e.g., superalloy)) can be achieved with a high purity chromide diffusion portion. For example, a chromium-silicon slurry can be applied to an article. The slurry can comprise chromium, silicon, an activator, and a carrier. The chromium and silicon in the slurry are high purity materials, e.g., the chromium can be chromium powder having a purity of greater than or equal to about 95 weight percent (wt %) chromium (or, more specifically, greater than or equal to 98.5 wt %, and, even more specifically, greater than or equal to about 99 wt %). Similarly, the silicon can be silicon powder having a purity of greater than or equal to about 95 wt % silicon (e.g., more specifically, greater than or equal to 97.5 wt %, and, even more specifically, greater than or equal to about 99 wt %).

In order to form the diffusion portion, the chromium and silicon are combined with the activator and the carrier. The slurry can comprise greater than or equal to about 55 wt % chromium, less than or equal to about 10 wt % silicon, about 10 wt % to about 30 wt % activator, and about 10 wt % to about 35 wt % carrier, or, more specifically, greater than or equal to about 60 wt % chromium, about 0.5 wt % to about 8 wt % silicon, about 10 wt % to about 20 wt % activator (e.g., more specifically, about 12 wt % to about 15 wt % activator), and about 10 wt % to about 20 wt % carrier (e.g., more specifically, about 12 wt % to about 17 wt % carrier), based upon a total weight of the slurry.

The slurry is applied to the article and then the article is heated to a sufficient temperature to vaporize the carrier, and cause the silicon and chromium to diffuse into the article and alloy. The resultant article comprises a diffusion portion, wherein the first 25% depth of the diffusion portion (measured from the surface of the article) comprises greater than or equal to about 50 wt % chromium, or, more specifically, greater than or equal to about 60 wt %, or, yet more specifically, greater than or equal to about 75 wt % chromium, based upon a total weight of the first 25% depth of the diffusion portion. The silicon can be present in this portion in an amount of less than or equal to about 3 wt %, or, more specifically, about 0.1 wt % to about 1.5 wt %, based upon a total weight of the first 25% depth of the diffusion portion. For example, up to about 25% of the diffusion portion depth from the surface (toward a center of the article), or more specifically, up to about 50% depth of the diffusion portion depth, comprises greater than or equal to about 50 wt % chromium, or, more specifically, greater than or equal to about 70 wt %, or, yet more specifically, greater than or equal to about 80 wt % chromium, and even more specifically, greater than or equal to about 90 wt % chromium.

The microstructure of the diffusion portion comprises alpha (α) chromium. For example, for the first 25% depth of the diffusion portion (or, more specifically, the first 40% depth, and even more specifically, the first 50% depth measured from the surface into the diffusion portion), the microstructure comprises greater than or equal to about 50% by volume α-chromium, or, more specifically, greater than or equal to about 70% by volume α-chromium, or, even more specifically, greater than or equal to about 80% by volume α-chromium, and yet more specifically, greater than or equal to about 90% by volume α-chromium, and even greater than or equal to about 95% by volume α-chromium. The entire diffusion portion can comprise greater than or equal to about 30% by volume α-chromium, or, more specifically, greater than or equal to about 50% by volume α-chromium, or, even more specifically, greater than or equal to about 70% by volume α-chromium.

The chromium and silicon employed in the process can be in the form of powders. The particular powder size (e.g., particle and agglomerate size) is dependent upon the particular application. For example, to form a diffusion portion in the surface of a NI based superalloy turbine component, a chromium size can be less than or equal to about 150 micrometers (e.g., less than or equal to about 100 mesh) and the silicon size can be less than or equal to about 150 micrometers (μm) for ease of processing.

The powders are combined with an activator and a carrier. The activator causes the reaction of the chromium and the silicon with each other and with the metal(s) of the article (e.g., Ni, Co, and so forth) at the processing temperatures (e.g., about 1,080° C. to about 1,120° C.). These processing temperatures attain the desired depth of diffusion as well as percentage of α-chromium. Exemplary activators include ammonium halides such as ammonium chloride, ammonium fluoride (e.g., ammonium bifluoride), ammonium bromide, as well as combinations comprising at least one of the foregoing activators. Depending upon the type of activator employed, water can adversely affect the activator, either causing the reaction to occur too soon, or inhibiting the reaction. Hence, in some embodiments, the carrier can be water-free (i.e., contains no water), or sufficient alcohol can be added to the carrier such that it binds with any water present. Also, the reaction can be performed in an inert atmosphere (e.g., in a hydrogen, argon, or similar atmosphere that does not chemically react with the carrier under the processing conditions). In order to inhibit adverse interaction between the activator and water in the atmosphere (e.g., prior to being disposed in the inert environment), the activator can be an encapsulated activator that remains encapsulated until heated, e.g., heated to a temperature of greater than or equal to about 200° C.

The carrier forms the powders and activator into a slurry (e.g., a gel like form) that can be applied to the article. The carrier can be an alcohol, a braze gel, as well as combinations comprising at least one of the foregoing carriers. Exemplary braze gels include Braz-binder Gel commercially available from Vitta Corporation, Bethal, Conn.

The slurry can be applied to the article in various fashions, and the desired viscosity of the slurry is dependent upon the application technique employed. For example, the slurry can be applied by spraying, painting, dipping, and so forth, as well as combinations comprising at least one of the foregoing. Optionally, the article can be cleaned before the slurry application, such as via grit blasting and so forth.

Once the slurry has been applied to the article, the article can be heated, e.g., in an inert environment. The coating can be heated to a sufficient temperature to activate the activator, vaporize the chromium and silicon, and attain the desired diffusion. For example, the article can maintained at a temperature of about 1,080° C. to about 1,120° C., for a sufficient period of time to attain the desired diffusion portion and diffusion depth. The period of time can be about 1 hour to about 7 hours, or, more specifically, about 3.5 hours to about 4.5 hours.

The resultant diffusion portion can comprise a depth (measured from the surface of the article) of less than or equal to about 60 micrometers (μm), or, more specifically, about 10 μm to about 50 μm, or, yet more specifically, about 15 μm to about 38 μm. The diffusion portion can also have greater than or equal to about 60 wt % chromium at the first 25% depth of the diffusion portion (as measured from the surface of the article), or, more specifically, greater than or equal to 65 wt %, or, even more specifically, greater than or equal to 75 wt %. More specifically, the first 25% depth of the diffusion portion comprises greater than or equal to 40% by volume α-chromium, or, specifically, greater than or equal to 50% by volume, yet more specifically, greater than or equal to 80% by volume, and even more specifically, greater than or equal to 90% by volume, and even greater than or equal to 95% by volume. The chromium weight at the surface is based upon the total weight percent of the surface diffusion portion (from the surface of the diffusion portion down 25% of the depth of the diffusion portion; e.g., if the diffusion portion has a 40 μm depth, the outer 10 μm of the diffusion portion would have greater than or equal to 60 wt % chromium and less than 5 wt % silicon (e.g., about 0.1 wt % to about 1.5 wt %).

The following examples are provided to further illustrate the present process and enhanced coatings, and are not intended to limit the scope hereof.

EXAMPLES

A diffusion portion can be formed by grit blasting a 3$^{rd}$ stage bucket for a turbine engine to clean its surface. A slurry can be formed by mixing 300 grams (g) of 99% purity chromium powder having a size (particle and agglomerate) of less than or equal to 150 μm, and 5 g of 99% purity silicon powder having a size (particle and agglomerate) of less than or equal to 150 μm, with 95 g of ammonium chloride, and 100 g of braze gel. The cleaned bucket can then be coated with the slurry (e.g., gel) by dipping the bucket into the slurry.

The dipped bucket will then be loaded into an atmosphere furnace. The furnace can then be ramped up to a temperature of 1,080° C. at a rate of about 10° F. (−12° C.) per minute with an inert atmosphere of hydrogen in the furnace. The furnace will be maintained at 1,080° C. to enable a 3 hour soak. After soak, the furnace is shut off and allowed to cool to room temperature with the bucket in the furnace. Once the furnace is cool, the bucket can then be unloaded and light grit blast to remove any remnant slurry on the surface.

The resultant bucket will have an approximately 0.001 inch (25.4 μm) chrome silicon diffusion portion formed in the surface of the alloy. The resultant bucket will comprise alpha-chrome with silicon and base alloy (i.e., nickel (Ni)) in the outer 25% to 50% of the bucket, with the inner area being mainly Ni with chrome to forming a finger-like structure diffusion zone, $Ni_2Cr$. Hence, the diffusion portion can comprise 70 wt % chrome and about 0.1 wt % to about 1.5 wt % silicon in the outer 25% of the diffusion portion depth. Actually, greater than or equal to 90% by volume, and even 100% by volume, of the outer 25% can be α-chromium phase. Hence, the diffusion portion can comprise greater than or equal to about 70 wt % chromium, about 0.5 wt % to about 1.5 wt % silicon, with the remainder being the alloy of the bucket. Additionally, the chromium and silicon will be alloyed together and alloyed with the alloy materials of the bucket (e.g., with the nickel).

The present process enables the formation of a diffusion portion having high concentrations of α-chromium. The process employs high temperatures in the formation of the diffusion portion. This diffusion portion is particularly useful in protecting superalloy articles (i.e., articles that comprise other than iron as the base metal) that are employed in high temperature environments such as a turbine.

Other coating techniques generally employ water and produce a coating (i.e., a layer on the surface of the article) with low levels of chromium (e.g., less than or equal to 30 wt % chromium based upon a total weight of the coating). Furthermore, these, typically painted on coatings do not comprise α-chromium.

Ranges disclosed herein are inclusive and combinable (e.g., ranges of "up to about 25 wt %, or, more specifically, about 5 wt % to about 20 wt %", is inclusive of the endpoints and all intermediate values of the ranges of "about 5 wt % to about 25 wt %," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for forming an article with a diffusion portion, comprising:

forming a slurry comprising chromium and silicon;

applying the slurry to the article; and heating the article to a sufficient temperature for a sufficient period of time to diffuse chromium and silicon into the article and form a diffusion portion comprising silicon and a microstructure comprising α-chromium;

wherein the slurry further comprises an activator and a carrier;

wherein the article has an initial thickness; and wherein the diffusion portion has a surface; and wherein a 25% depth of the diffusion portion, as measured from the surface comprises a chromium concentration of greater than or equal to 50 wt %, based upon a total weight of the 25% depth;

wherein the article with the diffusion portion has a final thickness, and wherein the initial thickness equals the final thickness.

* * * * *